US006216398B1

(12) United States Patent
Shipman et al.

(10) Patent No.: US 6,216,398 B1
(45) Date of Patent: Apr. 17, 2001

(54) WALL SYSTEM

(75) Inventors: David Allan Shipman, Grand Rapids; Michael Damien Luyckx, Holland; Adam Alan Luedke, Holland; Errol Stafford Pearsons, Holland, all of MI (US)

(73) Assignee: Steelcase Development Inc., Caledonia, MI (US)

( * ) Notice: Subject to any disclaimer, the term of this patent is extended or adjusted under 35 U.S.C. 154(b) by 0 days.

(21) Appl. No.: 09/224,740

(22) Filed: Dec. 31, 1998

(51) Int. Cl.[7] ..... A47B 87/00

(52) U.S. Cl. ..... 52/36.1; 52/71; 52/239; 160/351; 108/64; 108/92; 108/50.01

(58) Field of Search ..... 52/36.1, 36.2, 52/36.4, 36.5, 64, 70, 71, 239; 160/135, 351; 108/50.01, 50.11, 50.17, 64, 91–93; 312/239, 196

(56) References Cited

U.S. PATENT DOCUMENTS

| | | | | |
|---|---|---|---|---|
| 2,806,754 | | 9/1957 | Abeles et al. . | |
| 3,060,521 | | 10/1962 | Greco . | |
| 3,588,209 | | 6/1971 | Nathan . | |
| 3,921,348 | | 11/1975 | Kurzen . | |
| 4,046,437 | | 9/1977 | Caron et al. . | |
| 4,161,850 | * | 7/1979 | Peterson et al. | 52/239 |
| 4,221,086 | | 9/1980 | Berman . | |
| 4,295,307 | | 10/1981 | Jensen . | |
| 4,332,113 | | 6/1982 | Moore . | |
| 4,395,856 | * | 8/1983 | Smith et al. | 52/239 |
| 4,478,467 | | 10/1984 | Tyndall . | |
| 4,932,172 | | 6/1990 | Maas . | |
| 5,009,042 | | 4/1991 | Sacco et al. . | |
| 5,072,999 | | 12/1991 | Trotta et al. . | |
| 5,214,885 | | 6/1993 | Maas et al. . | |
| 5,282,341 | | 2/1994 | Baloga et al. . | |
| 5,394,658 | | 3/1995 | Schreiner et al. . | |
| 5,450,694 | | 9/1995 | Goranson et al. . | |
| 5,489,938 | | 2/1996 | Maruyama et al. . | |
| 5,511,348 | | 4/1996 | Cornell et al. . | |
| 5,584,546 | | 12/1996 | Gurin et al. . | |
| 5,651,219 | | 7/1997 | Baloga et al. . | |
| 5,655,822 | | 8/1997 | Roberts et al. . | |
| 5,675,946 | * | 10/1997 | Verbeek et al. | 52/36.1 |
| 5,730,513 | | 3/1998 | Lemon et al. . | |
| 5,765,315 | | 6/1998 | Nagamitsu et al. . | |
| 5,806,248 | | 9/1998 | Kim . | |
| 5,829,202 | | 11/1998 | Gongora et al. . | |
| 5,842,758 | | 12/1998 | Kelley . | |
| 5,996,287 | * | 12/1999 | Sullivan | 52/239 X |
| 6,003,275 | * | 12/1999 | Cornell et al. | 52/239 |

FOREIGN PATENT DOCUMENTS

| | | | | |
|---|---|---|---|---|
| 2262066 | * | 6/1974 | (DE) | 52/36.1 |
| 221441 | | 9/1924 | (GB) . | |
| 3-33366 | * | 2/1991 | (JP) | 52/36.1 |

* cited by examiner

*Primary Examiner*—Richard Chilcot
(74) *Attorney, Agent, or Firm*—Foley & Lardner

(57) ABSTRACT

A selectively reconfigurable wall system for use in a work environment is disclosed. The work environment provides at least a first work space and a second work space. The wall system is configured to control access to the work spaces and is adapted for association with a frame system having a plurality of floorstanding posts and overhead beams. The wall system includes an articulating partition adapted for mounting to a vertical member and for selective positioning between a first position and a second position. The articulating partition in the first position increases the relative level of privacy provided by the first work space, and the articulating partition in the second position increases the relative level of privacy provided by the second work space.

46 Claims, 8 Drawing Sheets

WALL SYSTEM

CROSS-REFERENCE TO RELATED APPLICATIONS

The following U.S. patent documents are cross-referenced and incorporated by reference: U.S. patent application Ser. No. 09/224,900 (Attorney Docket No. 26167-577) titled "MEDIA PRESENTATION SYSTEM" filed herewith; and U.S. Pat. No. 5,511,348 titled "FURNITURE SYSTEM" issued Apr. 30, 1996 to Cornell et al.

FIELD OF THE INVENTION

The present invention relates to a wall system. More particularly, the present invention relates to a selectively reconfigurable wall system having an articulating partition that is selectively positioned to reconfigure and control access to space within a work environment.

BACKGROUND OF THE INVENTION

It is known to divide a space provided within a work environment into one or more work spaces. According to such known arrangements, the work spaces may be further divided or otherwise arranged to create one or more work areas for use by individual workers or groups of workers. For example, it is generally known to divide an "open plan" work environment into large work spaces (e.g., group meeting areas or "commons") and small work spaces (e.g., worker offices). It is also generally known to reconfigure such work areas within the work spaces by arrangement of one or more articles of furniture, such as panel walls, worksurfaces (e.g., display surfaces, tables, horizontal surfaces, vertical display boards), storage units (e.g., closets, cabinets, filing systems), chairs, seating products, etc. in a manner intended to support workers in a wide variety of individual and group activities.

The dynamic work environment, characterized by a need for flexibility, reconfigurable work areas and an ability to support a wide variety of activities of both individual workers and project teams of varying sizes, has recently grown in prevalence. The dynamic work environment typically includes mobile articles of furniture such as seating products, work surfaces and storage products. Individual and team spaces in the dynamic work environment are ideally capable of rapid configuration and reconfiguration by the workers themselves or by rearrangement of articles of furniture. However, known arrangements for space division and reconfiguration to support a variety of individual or group activities in a highly efficient manner are not well-suited for the dynamic work environment.

According to known arrangements, a work environment may be divided (e.g., by fixed panel walls) into closed or private work spaces (e.g., worker offices) that provide privacy and security, as well as open or group work spaces that allow access or movement throughout the work spaces. However, known arrangements may provide insufficient space for large group meetings or team interaction if the work environment is divided into closed work spaces. Further, the known arrangements may provide insufficient space for private work, private meetings or secure work activities if the work environment is divided into predominantly open work spaces. Such known arrangements, therefore, may impose inflexible constraints on the range of activities that may efficiently be performed in the work environment.

According to other known arrangements, mobile structures (such as hanging panels or freestanding panels) may be used to divide space in a work environment. However, such known structures typically must be stowed or put aside when not in use, which occupies space within the work environment that could possibly be used for more productive worker activity. Moreover, such mobile structures may not provide a suitable level of visual, auditory or physical privacy (or security) when installed. Further, the mobile structures may be unwieldy and difficult to position.

Accordingly, it would be advantageous to provide for a selectively reconfigurable wall system that divides the space within a work environment to provide a desired level of privacy and security in one or more work spaces. It would also be advantageous to provide for a selectively reconfigurable wall system for use in a work environment that, when stowed, provides privacy and controls access to a work space. It would further be advantageous to provide for a selectively reconfigurable wall system for use in a work environment that controls access to a work space and divides the work space, without compromising performance, and is well-suited for use in a dynamic work environment.

SUMMARY OF THE INVENTION

The present invention relates to a selectively reconfigurable wall system for use in a work environment. The work environment provides at least a first work space and a second work space. The wall system is selectively reconfigured to selectively control access to the work spaces and is adapted for association with a frame system having a plurality of floorstanding posts and overhead beams. The wall system includes an articulating partition adapted for mounting to a vertical member and for selective positioning between a first position and a second position. The articulating partition, when in the first position, increases the relative level of privacy provided by the first work space, and when in the second position increases the relative level of privacy provided by the second work space.

The present invention also relates to a selectively reconfigurable wall system for use in a work environment. The work environment provides at least a first work space and a second work space. The wall system is selectively reconfigured to divide the work spaces and is adapted for association with a frame system having a plurality of floorstanding posts and overhead beams. The wall system includes an articulating partition adapted for mounting to a vertical member and for selective positioning between a first stowed position and a second stowed position. The articulating partition, when in the first stowed position, provides privacy in the first work space and when in the second stowed position controls access to the second work space.

The present invention further relates to a selectively reconfigurable wall system for use in a work environment. The work environment provides at least a first work space, a second work space and a third work space adjacent the second work space. The wall system is selectively reconfigured to control access to the work spaces and is adapted for association with a frame system having a plurality of floorstanding posts and overhead beams. The wall system includes an articulating partition adapted for mounting to a vertical member and for selective positioning between a first position and a second position. The articulating partition in the first position divides the first work space and the second work space, and in the second position divides the second work space and the third work space.

DETAILED DESCRIPTION OF THE EXEMPLARY EMBODIMENTS

Referring to the FIGURES, a selectively reconfigurable wall system adapted for use in a work environment is shown. According to preferred and other exemplary embodiments of the present invention, the work environment (i.e., any facility or environment for one or more workers) may include or be arranged to provide one or more work spaces for one or more workers. Each work space may be divided or otherwise arranged to provide one or more work areas for use by the workers, who may be engaged in any of a wide variety of individual activities or group activities, for example, as may be performed by members of a project team or department. Each work area may be configured to include one or more workstations according to preferred and other exemplary embodiments of the present invention. The workstations may be configured within a work area by including one or more articles of furniture intended to support the workers and their activities. As indicated in the FIGURES, the wall system provides work spaces and/or work areas in a variety of arrangements, each intended to support individual or collaborative activities of one or more workers.

According to a particularly preferred embodiment, the work environment is at least partially defined by architectural walls, a system of fixed or mobile panel walls, partial height partitions and stationary, mobile or articulating partitions. According to other preferred and alternative embodiments, the work environment and associated workstations may be arranged to include any of a wide variety of articles of furniture and other associated elements, including additional panel walls configured in any of a wide variety of orientations, space frames, chairs or other seating products, storage or casegoods products, tables and other worksurfaces, lighting products or systems, as well as other accessories, electronic or computing equipment and other systems (with associated connectivity such as cabling) known and used in the work environment.

Figure 1:
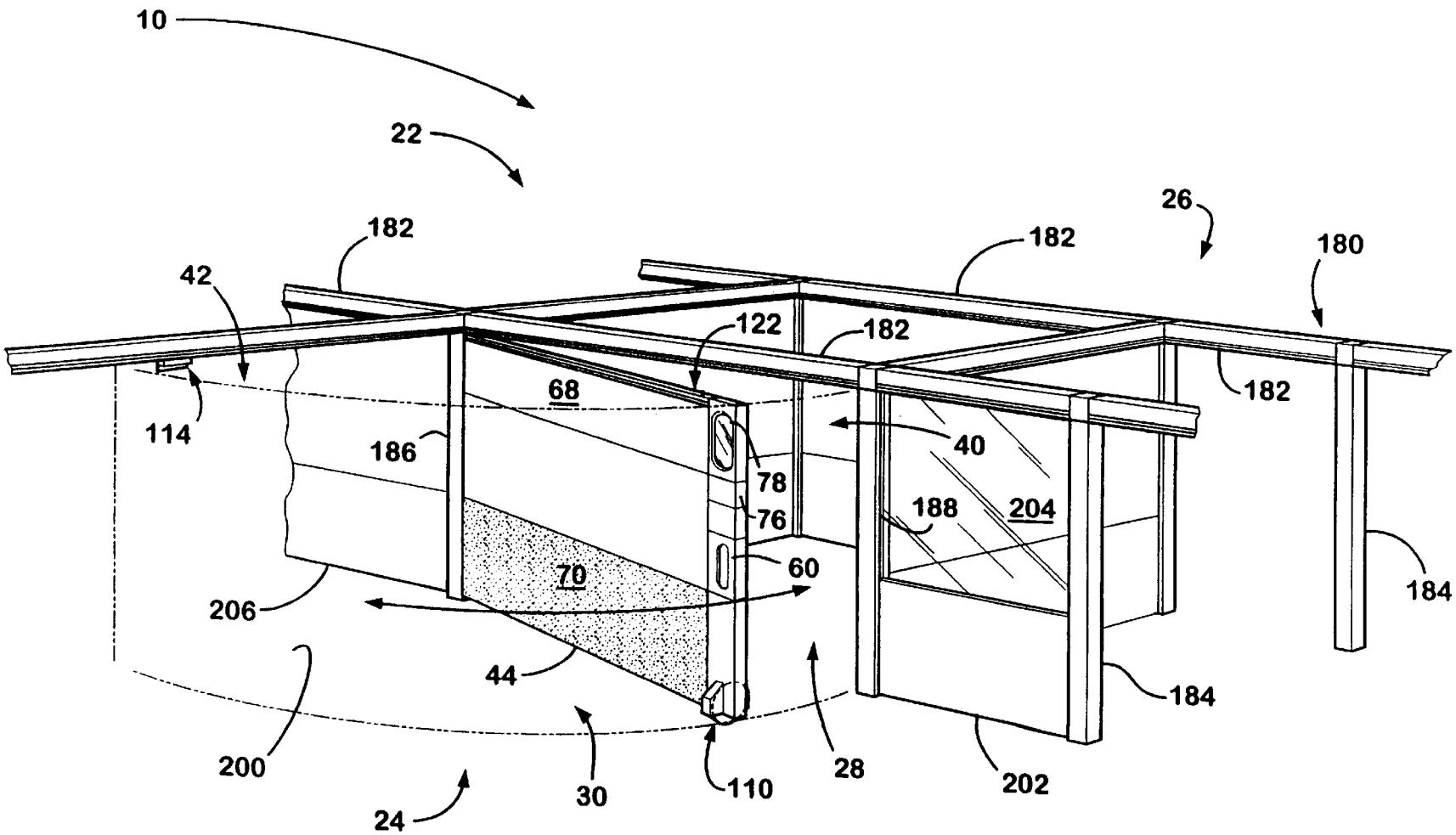
FIG. 1 is a fragmentary perspective view of a selectively reconfigurable wall system for use in a work environment according to an exemplary embodiment of the present invention.

Referring to FIG. 1, a selectively reconfigurable wall system 10 for use in a work environment 22 is shown according to an exemplary embodiment of the present invention. A frame system 180 of work environment 22 defines work spaces 24 and 26. Frame system 180 further defines a small group work area 28 and a large group work area 30 within work space 24. Frame system 180 includes structural members shown as overhead horizontal beams 182 and floorstanding vertical posts 184. Frame system 180 also defines openings (e.g., entranceway or doorway) for ingress and egress (shown as portal 40 and portal 42). Work spaces 24 and 26 may be provided with partitions (shown as a partial height wall 202 and a transparent wall 204) that may partition and divide work environment 22 into work spaces of varying sizes or configurations. According to alternative embodiments shown in the FIGURES, wall system 10 may include a top portion 210 attached to horizontal beam 182 that extends upwardly above frame system 180 (see FIG. 5).

The frame system can be any group of structural members installed in the work environment to define the work spaces. According to a particularly preferred embodiment, the structural members of the frame system may have a substantially square, hollow, cross-sectional configuration that facilitates the routing of various utilities (e.g., power wires, signal wires, lighting wires, etc.) to the work environment, such as the frame system disclosed in U.S. Pat. No. 5,511,348 titled "FURNITURE SYSTEM" issued Apr. 30, 1996 to Cornell et al. and incorporated by reference herein.

Figure 3A:
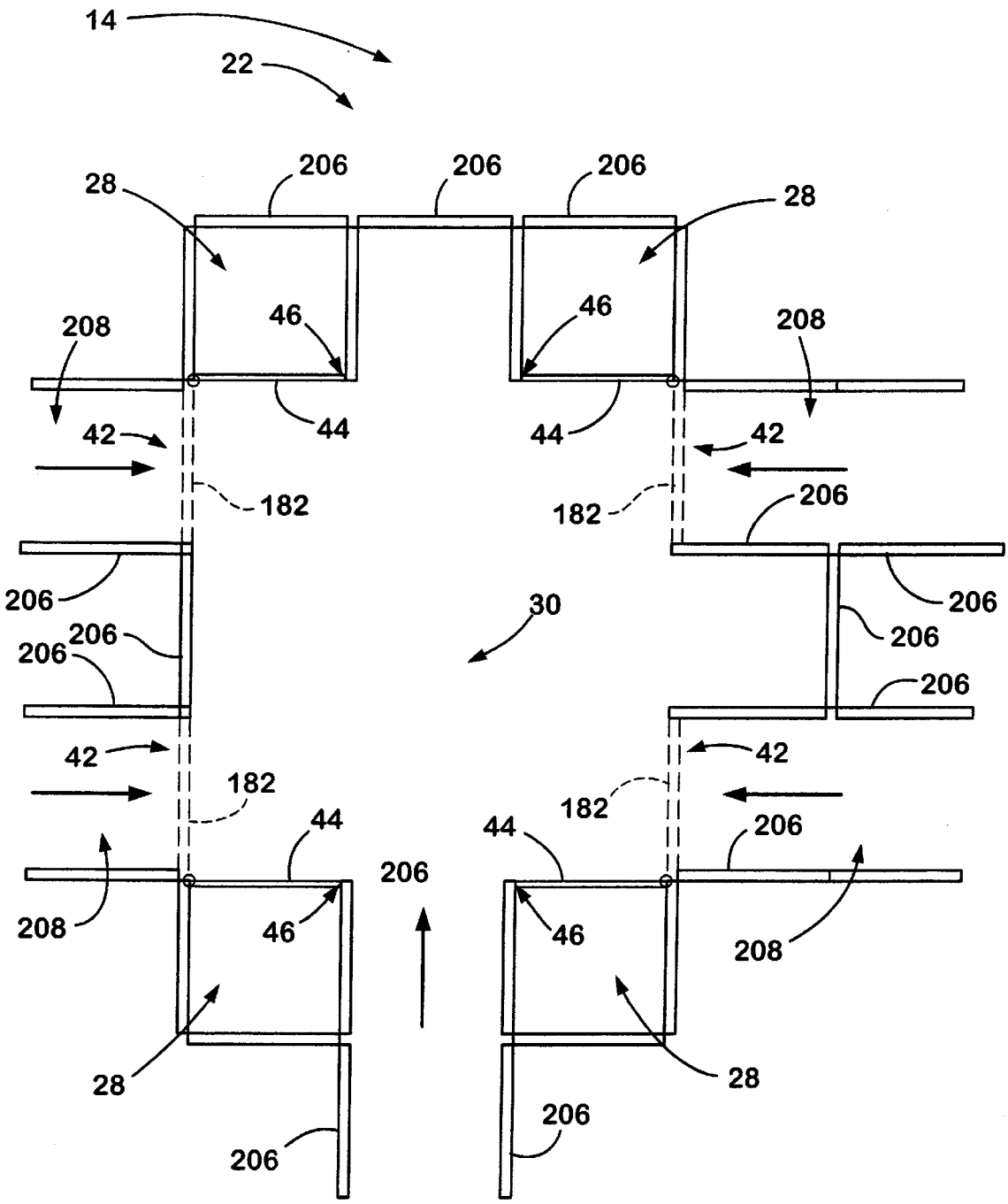
FIG. 3A is a top plan view of a selectively reconfigurable wall system for use in a work environment showing each articulating partition in a closed position according to an exemplary embodiment of the present invention.
Figure 3B:
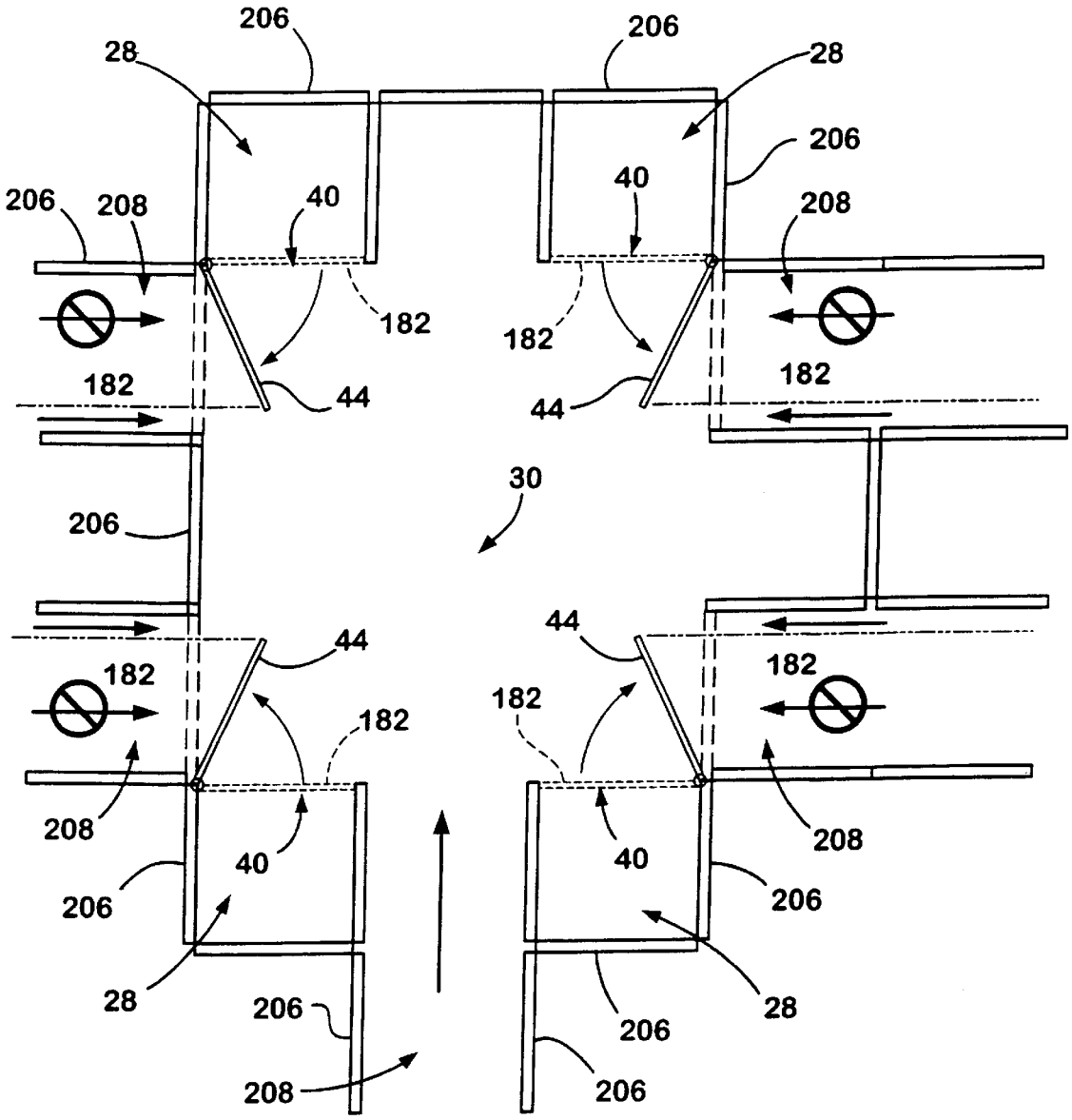
FIG. 3B is a top plan view of the wall system of FIG. 3A showing each articulating partition in a partially opened position.
Figure 3C:
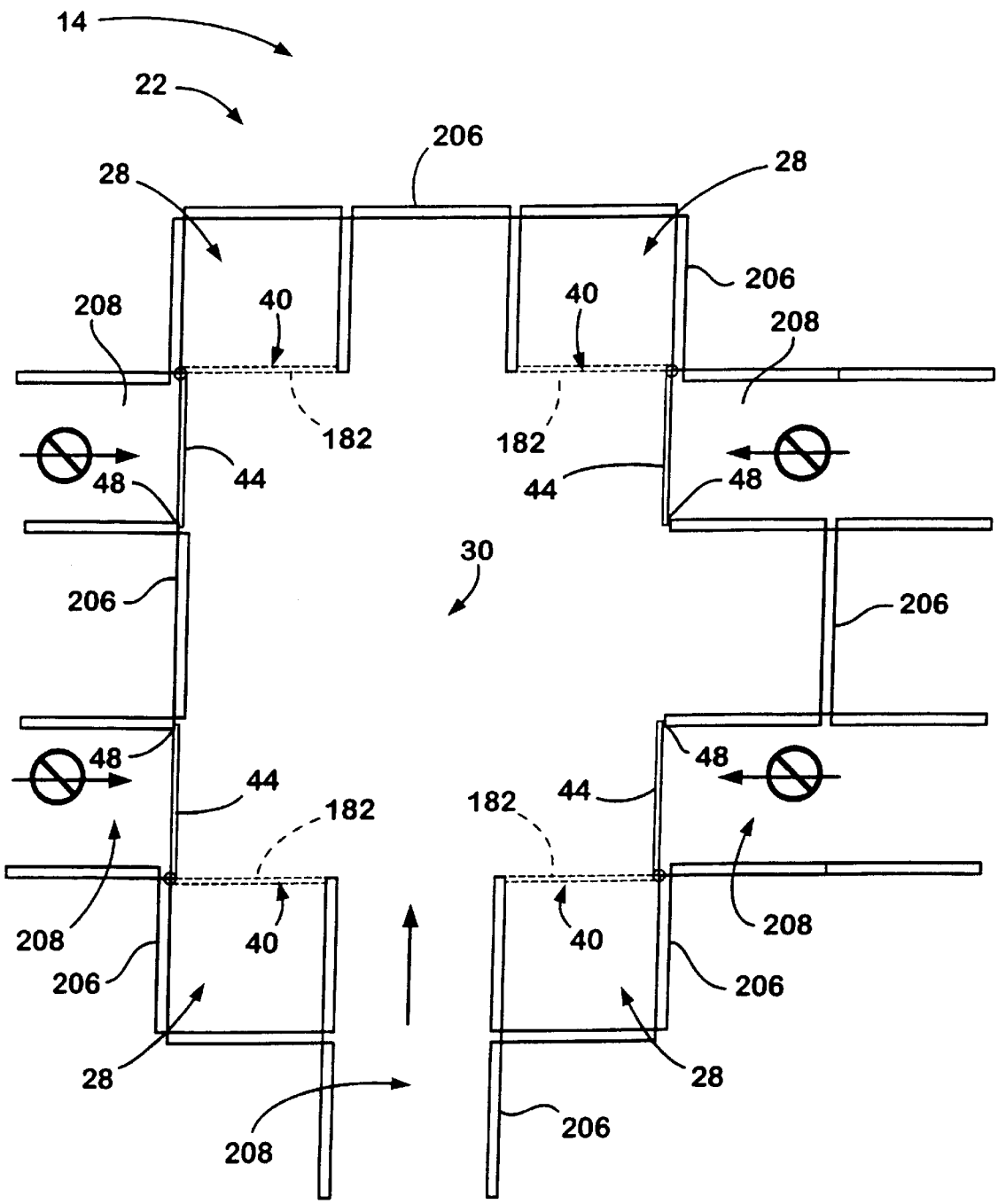
FIG. 3C is a top plan view of the wall system of FIG. 3A showing each articulating partition in an opened position.

Wall system 10 includes a panel wall shown as an articulating partition 44. Articulating partition 44 is attached to a left vertical post 186 of work area 28 by a pivot mechanism (shown as a plate hinge 100). According to a preferred embodiment, the articulating partition is pivotally mounted to the vertical post such that the articulating partition pivots or swings about the vertical post. As shown in FIGS. 3A through 3C, articulating partition 44 is adapted for selective positioning between a "use" position (shown as fully closed position 46 relative to work area 28) and a "stowed" position (shown as fully opened position 48 relative to work area 28). Thus, when articulating partition 44 is in the stowed position relative to work area 28, articulating partition 44 is in the use position relative to work area 30. According to a preferred embodiment (as shown in the FIGURES), articulating partition 44 controls access to work area 28 by completely blocking ingress and egress through portal 42 when in closed position 46 and controls access to work space 24 by completely blocking ingress and egress through portal 44 when in opened position 48. Moreover, articulating partition 44 secures (e.g., circumscribes or encloses) work area 28 when in closed position 46 (i.e., work area 28 is inaccessible to a worker situated in work area 30), and secures work area 30 when in opened position 48 (i.e., work area 30 is inaccessible to a worker situated in work space 26).

Figure 2A:
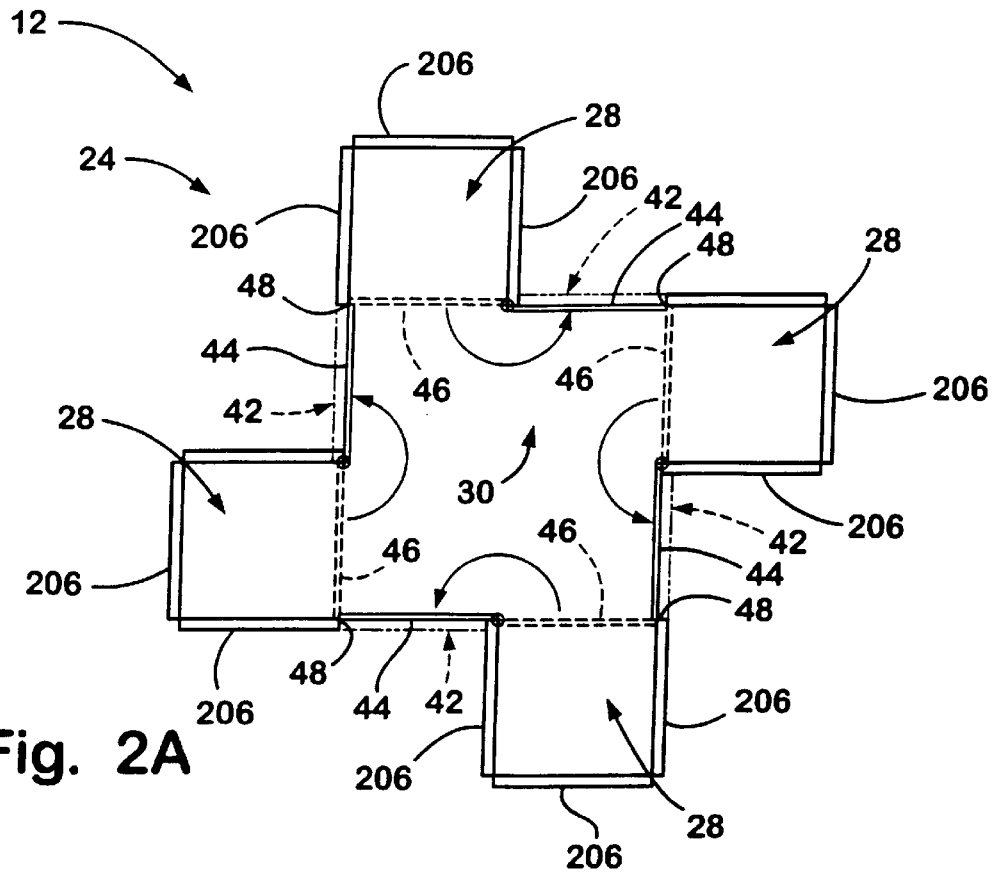
FIG. 2A is a top plan view of a selectively reconfigurable wall system for use in a work environment showing each articulating partition in an opened position according to an exemplary embodiment of the present invention.
Figure 2B:
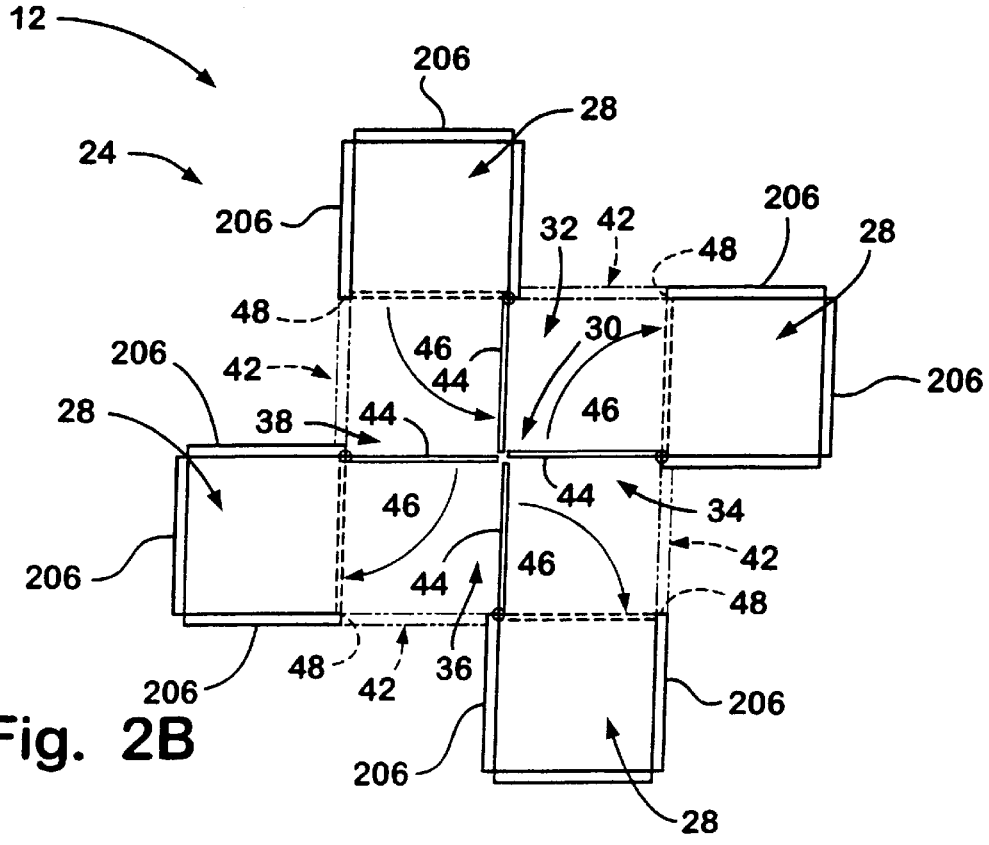
FIG. 2B is a top plan view of the wall system of FIG. 2A showing each articulating partition in a partially opened position.

According to any preferred embodiment, the wall system may be used to selectively reconfigure, divide, partition and control the use of the work spaces provided in the work environment to support individual workers and groups of workers in various activities. The wall system may be initially configured when installed in the work environment, and selectively reconfigured by selectively positioning one of the articulating partitions to form or reconfigure the work spaces for worker activities. As shown in FIG. 2A, work space 24 is configured in a first plan configuration when articulating partition 44 is in opened position 48; as show in FIG. 3A, work space 24 is configured in a second plan configuration when articulating partition 44 is in closed position 46; and as shown in FIG. 2B, work space 24 is configured in a third plan configuration when articulating partition 44 is positioned between closed position 46 and opened position 48. The amount of space that may be dedicated to large group and small group activities varies according to the selective positioning of articulating partition 44, even though the total amount of space in work space 24 may remain constant. For example, the amount of space for collaborative worker activities may be maximized when work space 24 is configured in the first plan configuration, because the combined space of work areas 28 and 30 is available to all workers regardless of their position within work space 24. In contrast, the space of work area 28 may be inaccessible to workers situated in work area 30 when work space 24 is configured in the second plan configuration, because articulating partition 44 divides work area 28 and work area 30. Further, when work space 24 is configured in the second plan configuration, the space provided by a walkway 208 is available to workers situated in work area 30 (or vice versa). In the third plan configuration, the space provided by work area 28 is available to workers situated in work area 30 (or vice versa), and the space provided by walkway 208 is available to workers situated in work area 30 (or vice versa).

A worker (or small group of workers) situated in a work space may achieve a level of relative privacy desired between worker interaction and worker isolation by selectively positioning the articulating partition. For example, the amount of private space for worker activities provided by work area 28 is maximized when articulating partition 44 is in closed position 46. Likewise, when articulating partition 44 is in closed position 46, work area 28 provides a greater level of relative privacy than when articulating partition 44 is in opened position 48, because the combined space of work areas 28 and 30 is not available to worker situated in work space 24. Referring to FIG. 2A, a selectively reconfigurable wall system 12 is shown according to an exemplary embodiment of the present invention. Wall system 12 includes four small group work areas 28, one large group work area 30 and four articulating partitions 44. When articulating partition 44 is in closed position 46 (see, e.g., FIG. 3A) each work area 28 provides a level of relative privacy that may be required for worker concentration or small meetings. When articulating partition 44 is in opened position 48, each work area 28 provides a level of relative privacy that may be suited for intermittent interaction between workers, even though a worker may be wholly situated within work area 28. Still further, when articulating partition 44 is in opened position 48 the level of relative privacy provided by work area 30 is greater than the level of relative privacy provided when articulation partition 44 is in closed position 46. This greater level of relative privacy is provided by work area 30 when articulating partition 44 is in opened position 48 because work space 24 is substantially secured by fixed partitions 206 and articulating partitions 44, such that limited input (i.e., distractions) may enter work space 24 through portal 42. Likewise, work area 28 is secured when articulating partition 44 is in closed position 46.

Referring to FIG. 2B, wall system 12 of FIG. 2A is shown with each articulating partition 44 positioned between closed position 46 and opened position 48. Each work area 28 provides a level of relative privacy that is less than the level of relative privacy provided when articulating partition 44 is positioned in closed position 46, but greater than the level of relative privacy provided when articulating partition 44 is positioned in opened position 48. Work area 30 is configured to include workstations 32, 34, 36 and 38. Workstations 32, 34, 36 and 38 are available for group activities or interaction between workers via ingress and egress through portal 40 and portal 42. In this configuration, the space of work area 28 is available to workers situated in workstations 32, 34, 36 and 38 (or vice versa), and the space provided by walkway 208 is available to workers situated in work area 30 (or vice versa). As will be understood by those who review this disclosure, when articulating partition 44 is positioned between closed position 46 and opened position 48, the space available to a worker situated in work area 28 may be greater than the space available when articulating partition 44 is in closed position 46.

The wall system may be reconfigured to redirect and control worker movement in and around the work environment by selective positioning of the articulating partitions. Referring to FIG. 3A, a selectively reconfigurable wall system 14 is shown according to an exemplary embodiment of the present invention. Wall system 14 includes four small group work areas 28, one large group work area 30, four articulating partitions 44 and four walkways 208. Referring to FIG. 3A, articulating partitions 44 are in closed position 46. In this configuration of wall system 14, articulating partitions 44 control movement within and around work space 24 by permitting ingress and egress through portals 42 and obstructing ingress and egress through portal 40. Referring to FIG. 3C, wall system 14 is shown with each articulating partition 44 in opened position 48. In this configuration of wall system 14, articulating partition 44 obstructs ingress and egress through portal 42, but permits ingress and egress through portal 40. Referring to FIG. 3B, wall system 14 is shown with each articulating partition 44 positioned between closed position 46 and opened position 48. In this configuration of wall system 14, articulating partition 44 partially permits and partially obstructs ingress and egress through portals 40 and 42 of work space 24. Thus, by positioning articulating partitions 44, movement through and around work space 24 may be redirected and controlled.

Figure 6:
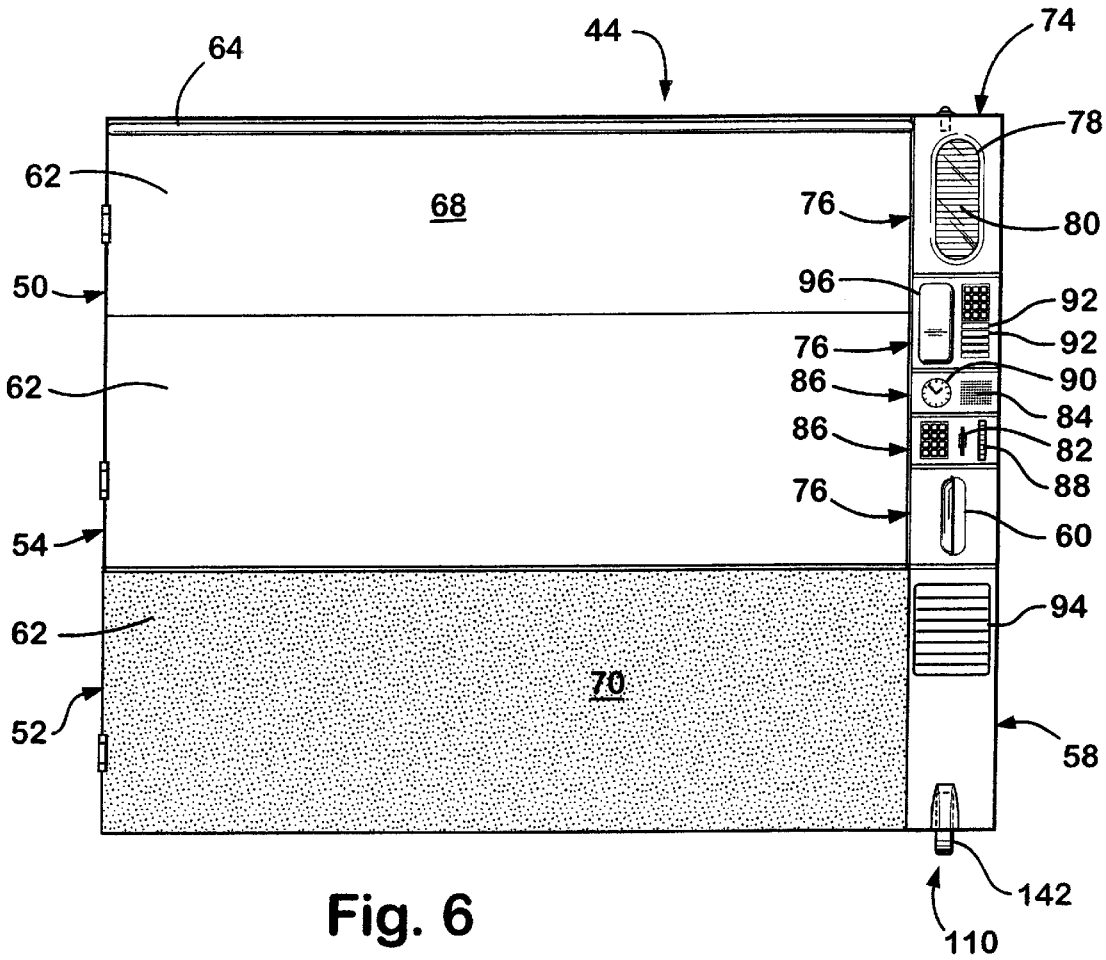
FIG. 6 is a sectional side elevation view of an articulating partition according to an exemplary embodiment of the present invention.

Referring to FIG. 6, articulating partition 44 of wall system 10 is shown according to an exemplary embodiment. Articulating partition 44 is essentially planar. A handle 60 is mounted to the face of articulating partition 44. Handle 60 aids in the selective positioning of articulating partition 44 between closed position 46 and opened position 48. According to a particularly preferred embodiment, the core of the articulating partition may be comprised of wood, aluminum, plastic, fiber, cardboard, acoustic dampeners or a variety of substantially rigid materials in a variety of structures (e.g., solid, layered, honeycomb, etc.).

Figure 4:
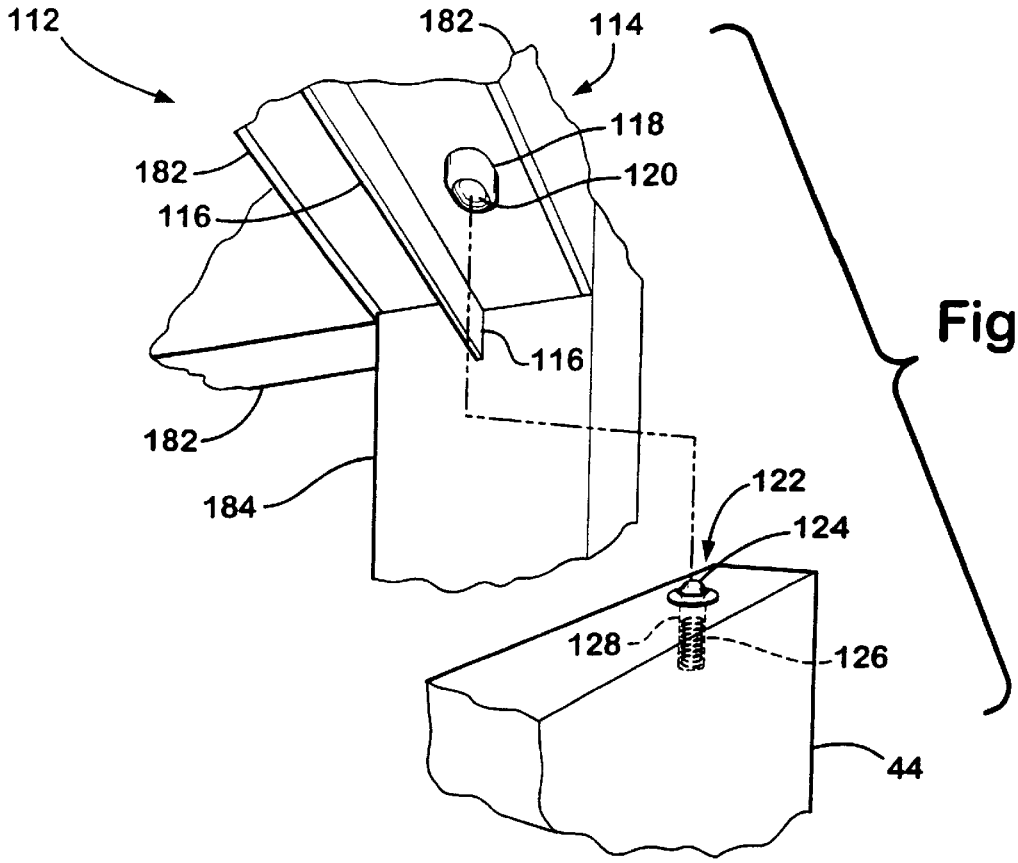
FIG. 4 is an exploded fragmentary perspective view of a locking mechanism according to an exemplary embodiment of the present invention.

Referring to FIG. 4, a locking mechanism 112 of wall system 10 is shown according to an exemplary embodiment of the present invention. Locking mechanism 112 fixes articulating partition 44 in closed position 46. Locking mechanism 112 includes a stop mechanism 114 and a detent mechanism 122. Stop mechanism 114 is mounted to the bottom of horizontal beam 182 of frame system 180. Stop mechanism 114 includes a protrusion 116 and a stopper 118 having an interior cavity 120. According to a preferred embodiment, the stopper is made of a substantially rigid material, such as rubber or plastic. When articulating partition 44 is in closed position 46, the top edge of articulating partition 44 engages protrusion 116 of stop mechanism 114 to impede articulating partition 44 from extending beyond protrusion 116. Stopper 118 engages detent mechanism 122 to fix articulating partition 44 in closed position 46. Detent mechanism 122 is retractably mounted to the top edge of articulating partition 44. A finger 124 of detent mechanism 122 engages a bias mechanism (shown as a spring 126) such that finger 124 is retractable into a cavity 128 of the top edge of articulating partition 44. When articulating partition 44 is in closed position 46, finger 124 of detent mechanism 122 extends into interior cavity 120 of stopper 118. When it is desired to position articulating partition 44 away from closed position 46, the application of a slight force on handle 60 causes finger 124 to retract out of interior cavity 120 of stopper 118 and retract into cavity 128 so that detent mechanism 122 completes its engagement with stop mechanism 114. According to an alternative embodiment, the locking mechanism may fix the articulating partition in the opened position. According to other alternative embodiments (as shown in FIG. 5), extrusion 130 is mounted to top edge of articulating partition 44, circumscribes finger 124, and increases in height from the top edge of articulating partition 44 to approximately the middle of finger 124 when finger 124 is not retracted into cavity 128.

Figure 5:
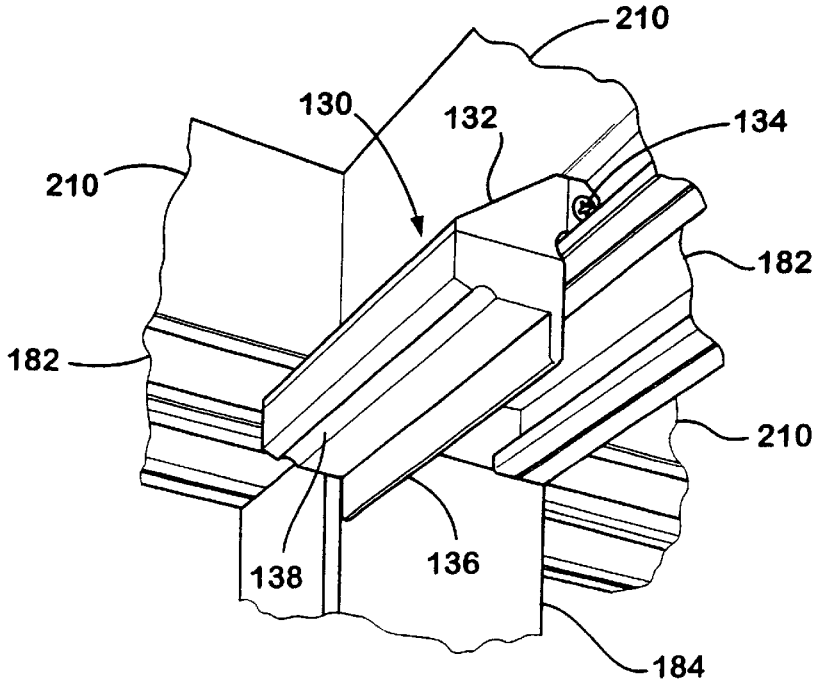
FIG. 5 is a fragmentary perspective view of a locking mechanism according to an alternative embodiment of the present invention.

FIG. 5 shows a locking mechanism 130 according to an alternative embodiment of the present invention. Locking mechanism 130 includes a stop mechanism 132. Stop mechanism 132 is mounted to horizontal beam 182 of frame system 180 by a fastener (shown as a screw 134). Locking mechanism 130 further includes a protrusion 136 that impedes articulating partition 44 from being positioned beyond protrusion 136. Locking mechanism 130 still further includes a groove 138. Groove 138, like interior cavity 120 of stopper 118, engages finger 124 to impede positioning of articulating partition 44 when finger 124 and groove 138 are in engagement. According to an alternative embodiment, the locking mechanism may serve to fix the articulating partition in the opened position. According to a preferred embodiment, the locking mechanisms may not include the protrusion, such that the articulating partition may be positioned on either side of the locking mechanisms.

Figure 7:
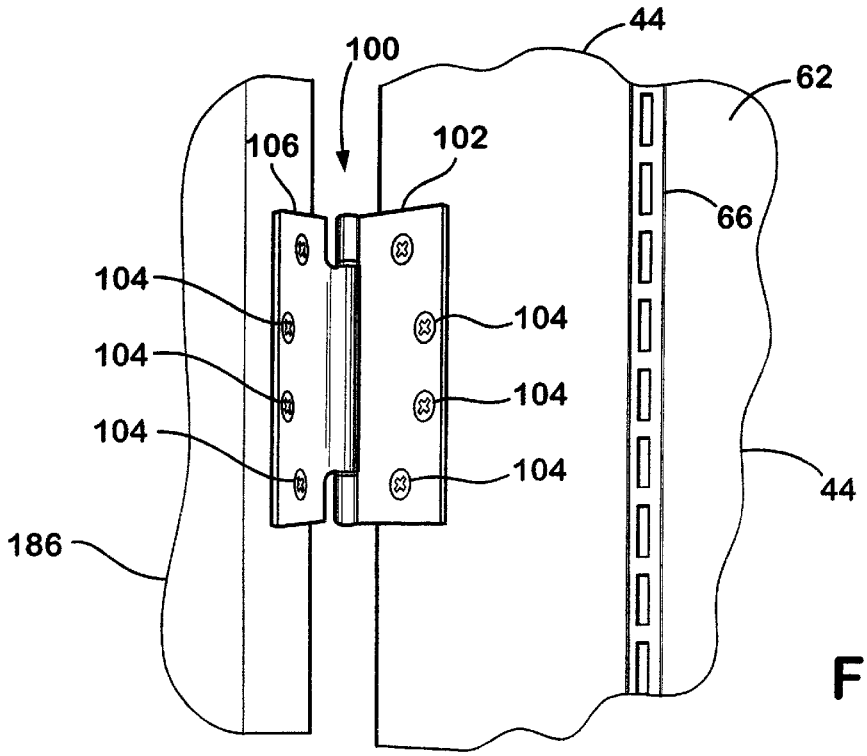
FIG. 7 is a fragmentary perspective view of a pivot mechanism according to an exemplary embodiment of the present invention.
Figure 8:
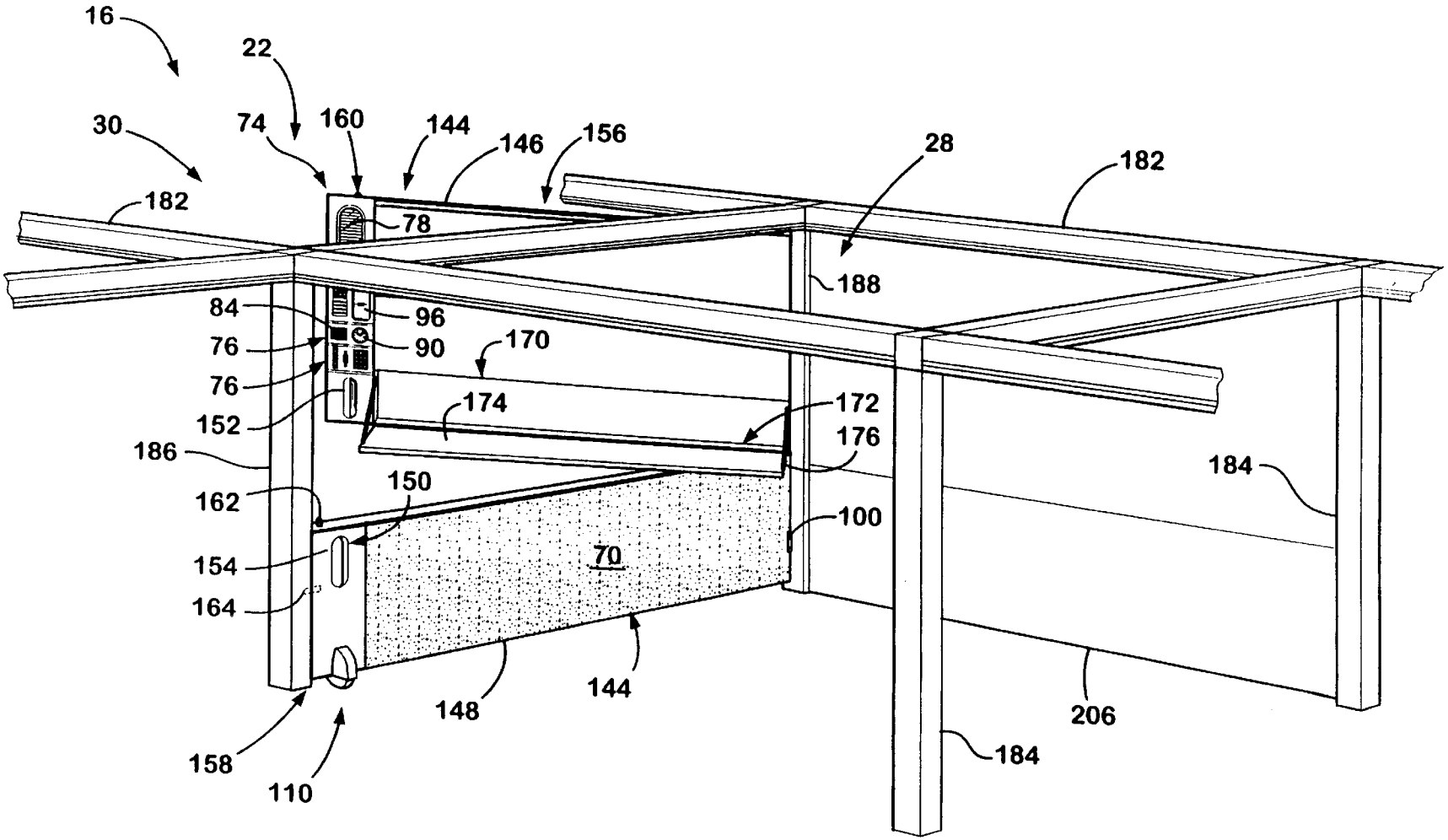
FIG. 8 is a fragmentary perspective view of a selectively reconfigurable wall system for use in a work environment according to an exemplary embodiment of the present invention.

FIG. 7 shows the pivot mechanism of wall system 10 according to an exemplary embodiment of the present invention. The pivot mechanism may be any type of mechanism (e.g., hinge, glide, hook arrangement, etc.) that permits the articulating partition to pivot or swing about the vertical post of the frame system. A set of fasteners (shown as screws 104) secures a right portion 102 of hinge 100 to the vertical edge of articulating partition 44. Screws 104 also secure a left portion 106 of hinge 100 to left vertical post 186, such that work area 28 is in a "left-handed" configuration. The "left-handed" configuration of work area 28 permits articulating partition 44 to pivot or swing about left vertical member 186 of work area 28. According to an alternative embodiment (as shown in FIG. 8), right portion 102 of hinge 100 may be fastened to right vertical post 188 of work area 28, and left portion 106 of hinge 100 may be fastened to the vertical edge of the articulating partition, such that work area 28 is in a "right-handed" configuration. According to other alternative embodiments, the articulating partition may pivot about the vertical post of the frame system by approximately 90 degrees relative to the vertical post. According to still other alternative embodiments of the present invention, the articulating partition may pivot about the vertical post of the frame system by approximately 360 degrees (e.g., by a glide mechanism) relative to the vertical post.

According to an exemplary embodiment of the present invention (as shown in FIGS. 6), a wheel assembly 110 may support the articulating partition. Wheel assembly 110 includes a caster 142 engaging a floor 200 and rotably mounted to the bottom of articulating partition 44. According to an alternative embodiment of the present invention, the wheel assembly may be provided with a brake mechanism to restrict movement of the articulating partition across the floor. According to other alternative embodiments, the wheel assembly may include a shock absorber or a height adjustment mechanism to vary the distance between the bottom of the articulating partition and any portion of the floor. According to still other alternative embodiments (as shown in FIG. 1), the wheel assembly 110 maybe mounted to articulation partition 44 such that the lower most edge is positioned a pre-selected distance above floor 200 to promote air circulation in work space 24. According to other alternative embodiments (as shown in FIG. 6), an air circulator 94 such as a vent (e.g., screen or slatted), a fan (e.g., fixed or oscillating), an air filter, etc. may also be associated with articulating partition 44 to promote air circulation throughout work space 24.

Referring to FIG. 8, a selectively reconfigurable wall system 16 for use in work environment 22 is shown according to an exemplary embodiment of the present invention. Wall system 16 includes an articulating partition 144 having an upper panel wall 146 and a lower panel wall 148. According to a preferred embodiment, the lower panel wall is a lesser vertical height than is the upper panel wall. Upper panel wall 146 and lower panel wall 148 are pivotally mounted to right vertical post 188 of frame system 180 by plate hinge 100. Wheel assembly 110 is mounted to the bottom of lower panel wall 148. A handle 150 having an upper portion 152 and a lower portion 154 spans upper and lower panel walls 146 and 148. Upper and lower panel walls 146 and 148 are detachably connected to each other so that articulating partition 144 can be selectively positioned as integrated or individual units. For example, upper panel wall 146 may be positioned in an opened position 156 while lower panel wall 148 is positioned in a closed position 158. According to alternative embodiments, the lower panel wall may also be positioned in the opened position while the upper panel wall is positioned in the closed position, or in any combination of positions between the opened position and the closed position.

A locking assembly 160 (similar to locking mechanism 112 shown in FIG. 4) is situated on the top edge of upper panel wall 146 of articulating partition 144. Lower panel wall 148 includes a top locking mechanism 162 and a side locking mechanism 164 (both similar to locking mechanism 112 shown in FIG. 4). Top locking mechanism 162 of lower panel wall 148 is situated on the top edge of lower panel wall 148 and engages a stop mechanism mounted to the bottom edge of upper panel wall 146 (as shown in FIG. 4). Side locking mechanism 164 of lower panel wall 148 is situated on the side edge of lower panel wall 148 and engages a stop mechanism mounted to left vertical post 186 of frame system 180 (as shown in FIG. 4). According to an alternative embodiment, the top and side locking mechanisms of the lower panel wall of the articulating partition may be passive (i.e., the locking mechanisms engage and disengage as a force is applied to the handle) or active (i.e., the top and side locking mechanisms engage and disengage when activated (e.g., by engaging a latch)).

Articulating partition 144, like articulating partition 44, may serve to divide space, provide the level of relative privacy desired by a worker or workers situated in the work areas, secure the work areas and work spaces, and redirect movement within work environment 22. For example, a worker who desires a level of relative privacy suited for intermittent interaction with other workers may position upper panel wall 146 in an opened position 156 and position lower panel wall 148 in a closed position 158 (or vice versa). This configuration of articulating partition 144 may signal that a worker situated in work area 28 desires some privacy, but is available to other workers situated in work area 30 on a limited basis. Still further, the selective positioning of articulating partition 144 redirects movement in work environment 22 by controlling ingress and egress through portals 40 and 42.

Articulating partitions 44 and 144 may include panels (shown in FIG. 6 as an upper panel 50, a lower panel 52, a beltway panel 54 and a vertical panel 74). A tile 62 that has functional and/or decorative use (e.g., display capabilities such as a tackable surface and/or marker board, electronic displays, reflective projector screens or like activities) may be mounted to the panels (e.g., by a mounting structure shown as a T-shaped hanger 64) to more effectively support worker activities. According to an alternative embodiment (as shown in FIG. 7), the tile may be adhered or friction fit to the panel or mounted to the face of articulating partition 44 by a rail 66. A decorative or functional surface treatment (shown as a dry-erase "white" board 68 and a textured fabric 70) may be positioned over the panels or tile 62. According to a preferred and other alternative exemplary embodiments of the present invention, the decorative or functional surface treatments may include, for example, a tackable or repositionable adhesive, clear overlay, writable clear film, cork or tack board, peg board, magnetic board, marker board, dry erase or "white" board, blackboard, paper or paper tablet, projection screen, graphics display, cloth, fabric, etc. to more effectively support worker activities within the work environment in a wide variety of combinations (i.e., with one surface differing in whole or in part from the other surface) that may be suited or adapted to a wide variety of functional or decorative purposes. According to other alternative embodiments, the panels and tiles may be interchangeable with the panels and tiles associated with the fixed panel walls, such that the ornamental appearance of the panels and tiles is substantially indistinguishable from the ornamental appearance of the fixed panel walls.

The articulating partition may be provided with one or more accessories, which may be accessible from either face of the articulating partition, suited for a particular application. Referring to FIG. 8, a shelf accessory 170 is shown. Shelf 170 may be retractably mounted to the articulating partition by a mounting structure (shown as a hinge 176). Shelf 170 is foldable relative to the face of articulating partition 144 between an opened position 172 and a closed position (not shown). Items such as books, mugs, writing utensils, erasers etc. may be stored on a surface (shown as a worksurface 174) of shelf 170 in opened position 172. According to alternative embodiments, the shelf may be provided with additional accessories such as a net or elastic strap for storing objects (e.g., pens, calculator, books), a hanger for hanging objects (e.g., files), a lock to fix the shelf in the opened position or the closed position, etc. When in the closed position, shelf 170 serves to store items (e.g., periodicals, pens, calculator, books, files, etc.). According to other alternative embodiments, the shelf may include viscous dampers to reduce vibration when the shelf is in the opened or closed position. As will be understood by those who review this disclosure, the shelf may be mounted to the upper panel wall, the lower panel wall or both upper and lower panel walls, at any position on any face of the articulating partition. According to a preferred embodiment, the upper panel wall may include a lock element to impede a worker from positioning the articulating partition when the shelf is in the opened position.

According to an alternative embodiment of the present invention, the accessories may be associated with modules 76 of vertical panel 74. Modules 76 may be adapted to receive the accessories, such as a window 78. Window 78 may be of various shapes and sizes (e.g., square, oval, bay). Window 78 may include a covering (shown as a horizontal blind 80) such as a shade or a vertical blind. According to other alternative embodiments (as shown in FIG. 6), modules 76 may include a lock element (shown as an electronic card access lock 82) such as a card reader, keypad encoder, metal key, etc. for security purposes. According to still other alternative embodiments (as shown in FIG. 6), module 76 may include a security alarm 84 such as a horn, bell whistle, electronic counting mechanism to register incidents of unauthorized access, etc. to signal a breach of the lock element or work area 28. According to other alternative embodiments, the accessories may include items to aid workers in their daily tasks (e.g., reflector, apparel storage device, illuminator, paper dispenser, retractable waste receptacle, display device, etc.).

Other accessories may include a delivery system to transfer items from each face of the articulating partition. Referring to FIG. 6, the delivery system is retractable relative to the face of articulating partition 44 and accessible from both faces of articulating partition 44, such that items inserted into the delivery system from one face of articulating partition 44 are accessible to a worker situated adjacent the other face of articulating partition 44. According to alternative embodiments, the delivery system may be transparent (i.e., to aid in the determination of whether items are contained inside) or opaque (i.e., to increase the level of relative privacy of the items in the mail receptacle). According to other alternative embodiments, the delivery system may include a lock and key assembly to provide security. Still other accessories may include an information storage module 96. Information storage module 96 may include any device that permits the posting and retrieval of data or information (e.g., notepad, voice messing device, billboard message center, computer docking station, digital mailbox, etc.). According to alternative embodiments, the information storage module may be rotably mounted to the articulating partition by a mounting mechanism (e.g., a swivel connected to the top and the bottom of the device so that the device spins between an accessible and non-accessible position) that allows access of messages from either face of the articulating partition. According to other alternative embodiments, a stylus or pen to input data into the information storage module may be attached to the articulating partition by a flexible member, such as a plastic coil or tensioned string. Other accessories may include an information display unit 86, which may include any device (shown as a temperature display 88, a time display 90 and a message display 92) for indicating, measuring or displaying information or variables associated with articulating partition 44.

Although only a few exemplary embodiments of the present invention have been described in detail in this disclosure, those skilled in the art who review this disclosure will readily appreciate that many modifications are possible in the exemplary embodiments (such as variations in sizes structures, shapes and proportions of the various elements, values of parameters, mounting arrangements, locking mechanisms, configurations of the work environment, or use of materials) without materially departing from the novel teachings and advantages of the invention. As will be understood by those who review this disclosure, according to alternative embodiments the wall system may be installed and configured (e.g., sized, shaped, positioned, etc.) within the work environment to facilitate the creation of any number of small group work spaces, large group work spaces, articulating partitions or walkways. Many configurations (such as those shown in, but not limited to, the FIGURES) are possible and within the scope of the present invention. Accordingly, all such modifications and variations are intended to be included within the scope of the invention as defined in the appended claims. Other substitutions, modifications, changes or omissions may be made in the design, operating conditions or arrangement of the exemplary, alternative or preferred embodiments without departing from the spirit of the invention as expressed in the appended claims.

What is claimed is:

1. A selectively reconfigurable wall system for use in a work environment providing at least a first work space and a second work space, the wall system configured to selectively control access to the work spaces and adapted for association with a frame system having a plurality of floorstanding posts and overhead beams, the wall system comprising:

an articulating partition adapted for mounting to a vertical member and for selective positioning between a first position and a second position;

a wheel assembly mounted to a bottom of the articulating partition;

wherein the articulating partition in the first position increases the relative level of privacy provided by the first work space and the articulating partition in the second position increases the relative level of privacy provided by the second work space.

2. The wall system of claim 1, wherein the vertical member is a floorstanding post of the frame system.

3. The wall system of claim 2, wherein the articulating partition in the first position secures the first work space and the articulating partition in the second position secures the second work space.

4. The wall system of claim 2, wherein the articulating partition in the first position provides privacy in the first work space and access to the second work space.

5. The wall system of claim 2, wherein the articulating partition in the first position and the second position redirects movement in the work environment.

6. The wall system of claim 2, further comprising a shelf mounted to the articulating partition.

7. The wall system of claim 2, wherein the articulating partition in the first position provides privacy in the first work space and the articulating partition in the second position is stowed.

8. The wall system of claim 2, wherein the articulating partition in the first position is stowed.

9. The wall system of claim 8, wherein the first work space is configured for small group activities and the second work space is configured for large group activities.

10. The wall system of claim 9, wherein the articulating partition is pivotally mounted to the vertical member.

11. The wall system of claim 9, wherein the articulating partition pivots approximately 360 degrees relative to the vertical member.

12. The wall system of claim 9, wherein the articulating partition engages an overhead beam of the frame system when positioned between the first position and the second position.

13. The wall system of claim 9, wherein the articulating partition further comprises a top panel wall and a bottom panel wall, each panel wall mounted to the vertical member and selectively positioned between the first position and the second position.

14. The wall system of claim 9, further comprising a locking mechanism having coacting elements mounted to the articulating partition and the frame system.

15. The wall system of claim 1, wherein the wheel assembly further comprises a brake mechanism.

16. The wall system of claim 9, further comprising at least one accessory mounted to the articulating partition.

17. A selectively reconfigurable wall system for use in a work environment providing at least a first work space and a second work space, the wall system configured to selectively divide the work spaces and adapted for association with a frame system having a plurality of floorstanding posts and overhead beams, the wall system comprising:

an articulating partition adapted for mounting to a vertical member and for selective positioning between a first stowed position and a second stowed position, wherein the articulating partition in the first stowed position provides privacy in the first work space and the articulating partition in the second stowed position controls access to the second work space.

18. The system of claim 17, wherein the articulating partition is provided with a surface treatment.

19. The system of claim 18, wherein the surface treatment is a markerboard.

20. The system of claim 18, wherein the surface treatment is a textured material.

21. A selectively reconfigurable wall system for use in a work environment providing at least a first work space, a second work space and a third work space adjacent the second work space, the wall system configured to selectively control access to the work spaces and adapted for association with a frame system having a plurality of floorstanding posts and overhead beams, the wall system comprising:

an articulating partition adapted for mounting to a vertical member and for selective positioning between a first position and a second position, wherein the articulating partition in the first position divides the first work space and the second work space and the articulating partition in the second position divides the second work space and the third work space.

22. The wall system of claim 21, wherein the articulating partition in first position secures the first work space.

23. The wall system of claim 21, wherein the articulating partition in second position secures the second work space.

24. The wall system of claim 21, further comprising at least one accessory mounted to the articulating partition.

25. The wall system of claim 21, wherein the articulating partition in the second position secures the first and second work spaces.

26. The wall system of claim 21, wherein the articulating partition in the first position provides privacy in the first work space and the articulating partition in the second position is stowed.

27. The wall system of claim 26, wherein the articulating partition in the first position is stowed.

28. The wall system of claim 27, wherein the articulating partition further comprises a top panel wall and a bottom panel wall, each panel wall mounted to the vertical member and selectively positioned between the first position and the second position.

29. The system of claim 24, wherein the accessory is a shelf mounted to the articulating partition.

30. The system of claim 29, wherein the shelf is retractable relative to the face of the articulating partition.

31. The system of claim 21, wherein the first work space is configured for small group activities and the second work space is configured for large group activities.

32. The system of claim 21, wherein a wheel assembly is mounted to the bottom of the articulating partition.

33. The system of claim 32, wherein the height of the wheel assembly is adjustable relative to a floor.

34. The system of claim 28, further comprising a locking mechanism having coacting elements mounted to the top and bottom panel walls of the articulating partition.

35. A selectively reconfigurable wall system for use in a work environment providing at least a first work space and a second work space, the wall system configured to selectively control access to the first work space and the second work space and adapted for association with a frame system having a plurality of floorstanding posts and overhead beams, the wall system comprising:

an articulating partition adapted for mounting to a vertical member and for selective positioning between a first position and a second position;

wherein the articulating partition engages an overhead beam of the frame system when positioned between the first position and the second position, and the articulating partition in the first position increases the relative level of privacy provided by the first work space and the articulating partition in the second position increases the relative level of privacy provided by the second work space.

36. The wall system of claim 35, wherein the articulating partition is configured to intersect the overhead beam of the frame system when positioned between the first position and the second position.

37. The wall system of claim 36 wherein the articulating partition further comprises a locking mechanism.

38. The wall system of claim 37, wherein the locking mechanism at least partially engages the overhead beam of the frame system when the articulating partition is positioned between the first position and the second position.

39. The wall system of claim 38, wherein the locking mechanism further comprises a detent mechanism.

40. The wall system of claim 39 wherein the locking mechanism further comprises a stop mounted to the overhead beam of the frame system mechanism configured to engage the detent mechanism.

41. A selectively reconfigurable wall system for use in a work environment providing at least a first work space and a second work space, the wall system configured to selectively control access to the work spaces and adapted for association with a frame system having a plurality of floorstanding posts and overhead beams, the wall system comprising:

an articulating partition comprising a top panel wall and a bottom panel wall, each panel wall mounted to the vertical member and selectively positionable between a first position and a second position;

wherein at least one of the panel walls in the first position increases the relative level of privacy provided by the first work space and at least one of the panel walls in the second position increases the relative level of privacy provided by the second work space.

42. The wall system of claim 41, further comprising a wheel assembly mounted to the bottom panel wall.

43. The wall system of claim 42, wherein the first position is a closed position and the second position is an opened position.

44. The wall system of claim 43, wherein the articulating partition in a reconfigured position comprises the bottom panel wall in the closed position and the top panel wall in the opened position.

45. The wall system of claim 44, wherein the articulating partition further comprises a central panel adapted for mounting of an accessory.

46. The wall system of claim 45, wherein the accessory comprises at least one of a shelf, window, lock, alarm, information display unit, information storage module, and combinations thereof.

* * * * *